United States Patent [19]

Kita et al.

[11] Patent Number: 4,576,743

[45] Date of Patent: Mar. 18, 1986

[54] PLATE CLEANER FOR LITHOGRAPHIC PRINTING PLATE

[75] Inventors: Nobuyuki Kita; Hiroshi Matsumoto, both of Shizuoka, Japan

[73] Assignee: Fuji Photo Film Co., Ltd., Kanagawa, Japan

[21] Appl. No.: 690,067

[22] Filed: Jan. 9, 1985

[30] Foreign Application Priority Data

Jan. 12, 1984 [JP] Japan ..... 59-4016

[51] Int. Cl.[4] ..... B41M 1/06; B41N 3/06; C11D 1/62; C11D 3/08

[52] U.S. Cl. ..... 252/524; 101/451; 101/465; 101/424; 134/40; 430/331; 252/140; 252/523; 252/526; 252/527; 252/528

[58] Field of Search ..... 430/331; 101/451, 424, 101/465; 134/40; 252/525, 526, 527, 528, 524, 140, 523

[56] References Cited

U.S. PATENT DOCUMENTS

| | | | |
|---|---|---|---|
| 3,394,653 | 7/1968 | Riesberg | 101/424 |
| 3,891,439 | 6/1975 | Katz | 430/331 |
| 4,028,281 | 6/1977 | Millard | 252/527 |
| 4,100,096 | 7/1978 | Rubin | 252/145 |
| 4,264,479 | 4/1981 | Flanagan | 252/524 |
| 4,374,036 | 2/1983 | Canale | 252/135 |
| 4,504,406 | 3/1985 | Dhillon | 252/143 |

FOREIGN PATENT DOCUMENTS

| | | | |
|---|---|---|---|
| 0097282 | 1/1984 | European Pat. Off. | 430/331 |
| 58-65697 | 4/1983 | Japan | 101/424 |

*Primary Examiner*—Dennis L. Albrecht

*Attorney, Agent, or Firm*—Sughrue, Mion, Zinn, Macpeak & Seas

[57] ABSTRACT

An improved process for restoring the hydrophilic property of stained non-image areas in a lithographic printing plate is described, which comprises treating said lithographic printing plate with a plate cleaner, wherein the improvement comprises using a plate cleaner comprising an aqueous solution containing a silicate and at least one surface active agent selected from the group consisting of cationic surface active agents and amphoteric surface active agents.

16 Claims, No Drawings

PLATE CLEANER FOR LITHOGRAPHIC PRINTING PLATE

FIELD OF THE INVENTION

This invention relates to a plate cleaner for a lithographic printing plate.

BACKGROUND OF THE INVENTION

Lithography is a printing system taking advantage of the natural mutual repulsion between water and oils. The surface of a lithographic printing plate comprises areas which accept water and repel an oily ink, and areas which repel water and accept an oily ink. The former areas constitute non-image areas, and the latter areas constitute image areas. Accordingly, if the surface properties between these two areas is disturbed, for example, if the hydrophilic property of the non-image areas is deteriorated for some reason, inks are apt to adhere to such hydrophilicity-deteriorated areas to cause background stains.

Such background stains are formed under various conditions. Typically, background stains are formed in the case where a lithographic printing plate is subjected to a burning-in treatment for the purpose of imparting high printing durability (i.e., run-length of printing) or in the case where the surface of a lithographic printing plate is allowed to stand in air without protection with a desensitizing gum.

These phenomena sometimes occur even when operation of a printing machine is suspended, e.g., because of disorders during printing or for recesses. Therefore, it is common to apply a desensitizing gum onto the printing plate during suspensions of printing. Further, when a lithographic printing plate unprotected with a desensitizing gum is left to stand with oleophilic substances being attached to the non-image areas thereof, such contaminated areas are rendered oil-sensitive, thus resulting in formation of stains. For example, the appearance of fingerprints in the background of prints is ascribed to this phenomenon. Furthermore, when the non-image areas take scratches, the scratches are filled with an ink and are gradually rendered oil-sensitive to cause stains.

In these cases, it is usual that a printing ink is first removed from the lithographic printing plate and the stained plate is then treated with a plate cleaner for restoring the hydrophilic property of non-image areas.

Such a plate cleaner conventionally includes a cleaner comprising an aqueous solution of sodium silicate. However, this plate cleaner, despite of its very high desensitizing activity, is disadvantageous in that a part of an image is damaged or adhesion of an ink to image areas is deteriorated because of its alkaline property when it is applied to lithographic printing plates produced from presensitized lithographic printing plate precursors such as positively-working presensitized lithographic printing plate precursors having a light-sensitive layer composed of an o-quinonediazide compounds, as described, e.g., in Japanese Patent Publication No. 28403/68, U.S. Pat. No. 3,046,120, etc., negative-working presensitized lithographic printing plate precursors having a light-sensitive layer composed of a binder having an acid group and a diazo resin, and the like, that are developed with an aqueous alkaline developer.

Furthermore, a plate cleaner using oxalic acid, as disclosed in U.S. Pat. No. 3,489,561, has a weak desensitizing property and an activity to corrode a metal support. Therefore, when it is applied to commonly employed lithographic printing plates comprising an aluminum plate as a support, the hydrophilic layer provided on the support, for example, a layer formed by a surface treatment to render hydrophilic, as described in U.S. Pat. No. 2,714,066, is susceptible to destruction to cause stains. Therefore, such a plate cleaner is not adequate for metal supports.

In general, when stains generate during printing, the printing plate surface is first treated with an ink remover (e.g., kerosene or hydrocarbon type solvents) to remove the ink, and then with a desensitizing agent. The above-described plate cleaner is also used as a desensitizing agent after the removal of ink. This means that the treatment for cleaning the plate surface should be done over two steps. Therefore, an emulsion type plate cleaner having both functions, i.e., serving as an ink remover and also as a desensitizing agent, has recently been developed. For example, Japanese Patent Application (OPI) No. 15702/77 (the term "OPI" as used herein refers to a "published unexamined Japanese patent application") discloses an emulsion type alkaline plate cleaner, and Japanese Patent Application (OPI) No. 2102/78 discloses an emulsion type acidic plate cleaner.

However, these emulsion type plate cleaners have disadvantages of troublesome handling, inferior workability, and high cost.

SUMMARY OF THE INVENTION

An object of this invention is to provide a plate cleaner for a lithographic printing plate which has excellent effects to desensitize non-image areas and to remove or prevent stains without adversely affecting image areas.

Another object of this invention is to provide a plate cleaner for a lithographic printing plate which effectively removes stains without damaging the hydrophilic surface of non-image areas.

A further object of this invention is to provide a plate cleaner for a lithographic printing plate which exerts excellent effects to remove stains and to desensitize non-image areas, irrespective of the type of the printing plates.

A still further object of this invention is to provide a plate cleaner for a lithographic printing plate which is easy to handle and inexpensive.

The inventors have extensively investigated to develop a plate cleaner which is free from the disadvantage of reducing adhesion of an ink to image areas as encountered with a non-emulsion type plate cleaner comprising an alkaline aqueous solution while retaining a desensitizing ability possessed by said plate cleaner, and which is applicable to any type of lithographic printing plates.

As a result, it has now been found that the above-described objects can be achieved by a plate cleaner comprising an aqueous solution containing a silicate and at least one surface active agent selected from the group consisting of cationic surface active agents and amphoteric surface active agents.

DETAILED DESCRIPTION OF THE INVENTION

The plate cleaner according to the present invention comprises an aqueous solution containing (a) a silicate, (b) at least one surface active agent selected from the group consisting of cationic surface active agents and amphoteric surface active agents, and optionally, (c) a nonionic surface active agent, and/or (d) an organic solvent.

The silicate which can be used in the present invention includes those represented by the formula $$M_2O.nSiO_2$$

wherein M represents an alkali metal, ammonium, or a quaternary ammonium (e.g., $N(CH_3)_4$, $N(C_2H_5)_4$, $N(CH_2OH)_4$, $N(C_2H_4OH)_4$, etc.); and n represents an integer of from 1 to 5.

Specific examples of these silicates include sodium silicate, lithium silicate, potassium silicate, rubidium silicate, cesium silicate, ammonium silicate, and the like. Water-soluble silicates are preferred, but water-insoluble silicates may also be used in the state of colloids in an aqueous solution.

The above-described silicate is used in an amount of from 0.5 to 20% by weight, and preferably from 2 to 10% by weight, based on the total weight of the plate cleaner.

The cationic or amphoteric surface active agent used in the present invention prevents deterioration of adhesiveness of an ink to image areas which is ascribed to swelling of a part of the image areas and the like, improves adhesion of an ink to image areas, and thereby prevents deterioration of printing durability.

The cationic surface active agents which can be used in the present invention include a trimethyl type, a benzyl type, an amine salt type, an imidazoline type, an amide type, and the like. The amphoteric surface active agents which can be used in the present invention include an alkylbetaine type, an alkylimidazoline type, and the like.

These surface active agents are used in an amount of from 0.01 to 10% by weight, and preferably from 0.05 to 5% by weight, based on the total weight of the plate cleaner.

These surface active agents can be used individually or in combinations of two or more thereof.

The nonionic surface active agent which can optionally be used in the present invention is effective to improve wettability of a plate surface and to remove a printing ink or make a printing ink distribution uniform, to thereby ensure the cleaning effect of the plate cleaner.

Examples of such a nonionic surface active agent are polyoxyethylene alkyl ethers, polyoxyethylene alkylphenyl ethers, sorbitan fatty acid esters, polyoxyethylene sorbitan fatty acid esters, polyoxyethylene sorbitol fatty acid esters, polyoxyethylene alkylamines, polyoxyethylene fatty acid esters, glycerin fatty acid esters, oxyethylene-oxypropylene block copolymers, and the like. Nonionic surface active agents having an HLB (i.e., hydrophile-lypophile balance) value in the range of from 8 to 20 are particularly preferred in the present invention. These nonionic surface active agents are generally used in an amount of from 0.05 to 20% by weight, and preferably from 0.1 to 10% by weight, based on the total weight of the plate cleaner.

The organic solvent which can optionally be used in the present invention is effective to dissolve or swell an ink present in scratches generated in non-image areas of a lithographic printing plate, thereby promoting dispersing of the ink in the surface active agent.

Organic solvents having a boiling point of from about 130° C. to about 300° C. are preferred in the present invention. Further, it is advantageous to select those organic solvents which are easily solubilized with the nonionic surface active agent used. It is particularly effective to use organic solvents which have water solubility of 10% by weight or less at ambient temperature (e.g., 20° C.), such as ethylene glycol dibutyl ether, ethylene glycol benzyl ether, ethylene glycol phenyl ether, methylphenylcarbitol, n-amyl alcohol, methylamyl alcohol, benzyl alcohol, methylcyclohexanone, cyclohexanol, cyclohexanone, butyl ethyl ketone, and the like. These organic solvents are used in an amount ranging from 0.1 to 5% by weight, and preferably from 0.3 to 3% by weight, based on the total weight of the plate cleaner.

The plate cleaner in accordance with the present invention can be used to remove background stains of a lithographic printing plate which are formed in any stage from plate making through printing. It exhibits a high ability to remove stains and is free from various problems as encountered with conventional plate cleaners, such as reduction in printing durability, reduction in adhesion of an ink to a printing plate surface, and corrosion or damage of a hydrophilic surface of non-image areas.

The plate cleaner according to the present invention may contain a nitrate, a sulfate, a phosphate, and the like in addition to the above-described components. It may further contain a wetting agent, e.g., glycerin, ethylene glycol, propylene glycol, butylene glycol, pentadiol, hexylene glycol, diethylene glycol, triethylene glycol, etc. It is also possible to color the plate cleaner with dyes and the like.

The present invention will now be illustrated in greater detail with reference to examples, but it should be understood that the present invention is not limited to these examples. In examples, all percents and parts are given by weight unless otherwise indicated.

EXAMPLE 1

Seventy-five parts of a 40% aqueous solution of sodium silicate ($SiO_2/Na_2O$ molar ratio=2) and 8 parts of sodium hydroxide having a purity of 97% were dissolved in 880 parts of pure water. Then, 30 parts of a polyoxyethylene alkylphenyl ether (Nissan Nonion HS 210, produced by Nippon Oil & Fats Co., Ltd.) as a nonionic surface active agent and 2 parts of an alkyldimethylbenzylammonium chloride (Cation $F_2$ 50E, produced by Nippon Oil & Fats Co., Ltd.) as a cationic surface active agent were dissolved in the solution to prepare a plate cleaner.

One part of polyhydroxyphenyl naphthoquinone-1,2-diazido-5-sulfonate, which was described in Example 1 of U.S. Pat. No. 3,635,709, and 2 parts of a novolak type cresol-formaldehyde resin were dissolved in 40 parts of methyl cellosolve to prepare a light-sensitive solution. A 0.2 mm thick aluminum plate was subjected to graining, thoroughly washed with water, and dried. The above prepared light-sensitive solution was applied onto the aluminum plate by means of a whirler, followed by drying, to thereby produce a positive-working presensitized printing plate precursor having provided thereon a light-sensitive layer of about 2.0 $g/m^2$. The presensitized printing plate precursor was then exposed to light through a positive transparency bearing halftone-dot image, developed with a developer for a positive plate (DP-3, produced by Fuji Photo Film Co., Ltd.; 6-fold diluted with water), washed with water, and dried.

The thus produced printing plate was divided into four, and the resulting four sample plates were designated as Sample Plates A, B, C and D, respectively. Sample Plates A to D were treated according to the conditions shown in Table 1.

TABLE 1

| Sample | Type of Stains | Test Conditions |
|---|---|---|
| A | Stains by air-oxidation | Preserved in a dryer at 150° C. for 3 hours without protection by gumming |
| B | Stains by scratches | Scratched by a scratch tester (manufactured by Shinto Kagaku K.K.) with a diamond needle 4R under a load of 100 g, 200 g or 300 g, and then allowed to stand in air for 3 days |
| C | Stains by oil | Treated with absorbent cotton impregnated with a solution of oleic acid (1 g) in mineral spirit (10 g), followed by buff-drying |
| D (Control) | None | Subjected to gumming followed by buff-drying, and preserved |

The thus treated sample plates were mounted on a printer "KOR" manufactured by Heidelberg Co. (West Germany) to carry out printing. Prior to printing, Sample Plates A to C were treated with the above prepared plate cleaner for about 30 seconds, and the plate cleaner was wiped off with water-containing sponge. As a result, normal prints with perfect adhesion of an ink could be obtained after 7 or 8 prints from the start of printing in each case. No background stains were formed even after producing 30,000 prints. Comparing between Sample Plates A to C and Control Sample Plate D not having been treated with a plate cleaner, no difference was observed in terms of size and wear of halftone dots on the image areas. Further, Sample Plates A to C produced normal prints with respect to ink adhesion, formation of stains, and the like as compared with Control Sample Plate D.

The same procedures as described above were repeated except for using no cationic surface active agent in the plate cleaner formulation. It was not until about 30 prints had been printed from the start of printing that normal prints were obtained.

EXAMPLE 2

Fifty parts of a 40% aqueous solution of sodium silicate ($SiO_2/Na_2O$ molar ratio=2.5) and 15 parts of potassium hydroxide (50% aqueous solution) were dissolved in 600 ml of pure water. To the solution were then added 15 parts of polyoxyethylene oleyl ether (Emulgen #420, produced by Kao Atlas K.K.) as a nonionic surface active agent, 0.5 part of dialkyldimethylammonium chloride (Coatamin D-86P, produced by Kao Atlas K.K.) as a cationic surface active agent, and 10 parts of laurylbetaine (Anhitol 24B, produced by Kao Atlas K.K.) as an amphoteric surface active agent. Water was added thereto to make 1,000 ml, thereby preparing a plate cleaner.

A 0.24 mm thick aluminum plate was degreased by soaking in a 7% aqueous solution of sodium tertiary phosphate at 60° C. After washing with water, the aluminum plate was grained with a nylon brush while applying a pumice-water slurry, followed by washing with water. The thus grained aluminum plate was immersed in a 5% aqueous solution of sodium silicate ($SiO_2/Na_2O$ molar ratio=2.0) maintained at 70° C. for 30 to 60 seconds, thoroughly washed with water, and dried.

A light-sensitive solution having the following formulation was applied onto the above prepared aluminum support to obtain a negative-working presensitized lithographic printing plate precursor having a light-sensitive layer coated at 1.8 g/m$^2$ on a dry basis.

| Light-Sensitive Solution Formulation | |
|---|---|
| 2-Hydroxyethyl Methacrylate Copolymer (prepared by the method described in Example 1 of U.S. Pat. No. 4,123,276) | 2.0 parts |
| 2-Methoxy-4-hydroxy-5-benzoyl-benzenesulfonate of a Condensate between p-Diazophenylamine and Paraformaldehyde | 0.12 part |
| Oil Blue #603 (produced by Orient Kagaku Kogyo K.K.) | 0.03 part |
| 2-Methoxyethanol | 15 parts |
| Methanol | 10 parts |
| Ethylene Dichloride | 5.0 parts |

The resulting printing plate precursor was exposed to light through a negative transparency bearing half-tone dot image, developed with an aqueous developer having the following formulation, washed with water, and dried.

| Developer Formulation | |
|---|---|
| Sodium Sulfite | 3.0 parts |
| Benzyl Alcohol | 30.0 parts |
| Triethanolamine | 15.0 parts |
| Monoethanolamine | 4 parts |
| Sodium t-Butylnaphthalenesulfonate | 10 parts |
| Pure Water | 1,000 parts |

The thus produced lithographic printing plate was divided into four, and the resulting four sample plates were designated as Sample Plates E, F, G, and H. Sample Plates E to H were treated in the same manner as described for Sample Plates A to D in Example 1, respectively. As a result, clear prints were obtained after 10 to 20 prints from the start of printing with Sample Plates E to G, indicating no substantial difference from the Control Sample Plate H not having been treated with the plate cleaner.

Further, even after production of 30,000 prints, no stains were formed, and no difference in size or wear of halftone dots of image areas on the printing plate was observed when comparing with Sample Plate H.

Furthermore, the same procedures as described above were repeated except that the plate cleaner used did not contain dialkyldimethylammonium chloride. It was not until 50 prints had been produced from the start of printing that normal prints were obtained. After about 20,000 prints, the highlight area of each printing plate partly disappeared.

EXAMPLES 3 TO 7

The same procedures as described in Example 1 were repeated except that the four test plates were designated as Sample Plates I, J, K, and L, respectively, and the plate cleaner having the formulation shown in Table 2 was used. For comparison, a plate cleaner containing no cationic or amphoteric surface active agent was tested in the same manner. The results obtained are also shown in Table 3.

TABLE 2

| Plate Cleaner Formulation | | | | | | |
|---|---|---|---|---|---|---|
| | Example | | | | | Comparative |
| Component | 3 | 4 | 5 | 6 | 7 | Example 1 |
| Silicate | | | | | | |
| Sodium silicate (40% aq. soln.), $SiO_2/Na_2O$ molar ratio = 2 | — | — | 75 g | — | 75 g | — |
| Sodium silicate (40% aq. soln.), $SiO_2/Na_2O$ molar ratio = 2.5 | — | — | — | 75 g | — | — |
| Sodium silicate (40% aq. soln.), $SiO_2/Na_2O$ molar ratio = 3 | 75 g | — | — | — | — | 75 g |
| Sodium silicate (powder), $SiO_2/Na_2O$ molar ratio = 1 | — | 20 g | 5 g | — | — | — |
| Alkali | | | | | | |
| Sodium hydroxide | — | 3 g | — | 10 g | — | — |
| Potassium hydroxide | 10 g | — | — | — | 5 g | 10 g |
| Lithium hydroxide | — | — | 5 g | — | 5 g | — |
| Nonionic Surface Active Agent (HLB) | | | | | | |
| Polyoxyethylene oleyl ether (13.6)[1] | 15 g | — | — | — | — | 15 g |
| Polyoxyethylene cetyl ether (10.7)[2] | — | — | — | 10 g | — | — |
| Polyoxyethylene octylphenyl ether (13.1)[3] | — | — | 10 g | — | — | — |
| Polyoxyethylene nonylphenyl ether (7.8)[4] | — | — | 5 g | — | — | — |
| Nonionic Surface Active Agent (HLB) | | | | | | |
| Polyoxyethylene nonylphenyl ether (12.4)[5] | — | — | — | 5 g | — | — |
| Oxyethylene-oxypropylene block copolymer[6] | — | 10 g | — | — | — | — |
| Polyoxyethylenealkylamine[7] | — | — | — | — | 15 g | — |
| Cationic or Amphoteric Surface Active Agent | | | | | | |
| Lauryltrimethylammonium chloride[8] | — | 0.5 g | — | — | 0.1 g | — |
| Alkylbenzyldimethylammonium chloride[9] | — | — | — | — | 0.1 g | — |
| Alkylbenzyldimethylammonium chloride[10] | — | — | 1.0 g | — | — | — |
| Alkylbenzyldimethylammonium chloride[11] | 0.5 g | — | — | 1.0 g | — | — |
| Dimethylalkylbetaine[12] | 5.0 g | 5.0 g | — | — | 5.0 g | — |
| Alkylglycine[13] | — | — | — | 5.0 g | — | — |
| Pure Water | to make 1000 ml | to make 1000 ml | to make 1000 ml | to make 1000 ml | to make 1000 ml | to make 1000 ml |

Note:
[1]Emulgen #420, produced by Kao Atlas K.K.
[2]Emulgen #210, produced by Kao Atlas K.K.
[3]Emulgen #810, produced by Kao Atlas K.K.
[4]Emulgen #903, produced by Kao Atlas K.K.
[5]Emulgen #909, produced by Kao Atlas K.K.
[6]Emulgen PP-230, produced by Kao Atlas K.K.
[7]Amite 320, produced by Kao Atlas K.K.
[8]Coatamin 24P, produced by Kao Atlas K.K.
[9]Sanisol C, produced by Kao Atlas K.K.
[10]Cation $F_2$ 50, produced by Nippon Oil & Fats Co., Ltd.
[11]Cation $S_2$-100, produced by Nippon Oil & Fats Co., Ltd.
[12]Anone BF, produced by Nippon Oil & Fats Co., Ltd.
[13]Anone LG, produced by Nippon Oil & Fats Co., Ltd.

TABLE 3

| Results of Test | | | | | | |
|---|---|---|---|---|---|---|
| | Example | | | | | Comparative |
| Item | 3 | 4 | 5 | 6 | 7 | Example 1 |
| Ability to Remove Stains[14] | | | | | | |
| Sample Plate I | A | A | A | A | A | A |
| Sample Plate J | A | A | A | A | A | A |
| Sample Plate K | A | A | A | A | A | A |
| Conclusion: | | | | | | |
| Adhesion of Ink | A | A | A | A | A | B |
| Printing Durability | A | A~B | A | A | A | B~C |

Note:
[14]A: Equal to Sample Plate L
B: Slightly inferior to Sample Plate L
C: Inferior to Sample Plate L Tables 2 and 3 show that the plate cleaners according to the present invention are excellent in ability to remove stains. It can also be seen that application of the plate cleaner of the present invention does not substantially influence adhesion of printing ink in image areas. To the contrary, the printing plate treated with the comparative cleaner required 25 to 40 prints from the start of printing for achieving satisfactory adhesion of an ink and was susceptible to influences on printing durability (about 20–30% reduction in printing durability), although the comparative plate cleaner had a high ability to remove stains.

While the invention has been described in detail and with reference to specific embodiments thereof, it will be apparent to one skilled in the art that various changes and modifications can be made therein without departing from the spirit and scope thereof.

What is claimed is:

1. A process for restoring the hydrophilic property of stained non-image areas in a lithographic printing plate, which comprises treating said lithographic printing plate with a plate cleaner, wherein the improvement comprises using a plate cleaner comprising an aqueous solution containing a silicate in an amount of from 0.5 to 20% by weight based on the total weight of the plate cleaner and at least one surface active agent selected from the group consisting of cationic surface active agents and amphoteric surface active agents, said surface active agent being present in an amount of from 0.01 to 10% by weight based on the total weight of the plate cleaner.

2. A process as in claim 1, wherein the silicate is represented by the formula $$M_2O.nSiO_2$$

wherein M represents an alkali metal, ammonium or a quaternary ammonium; and n represents an integer of from 1 to 5.

3. A process as in claim 2, wherein M represents a quaternary ammonium selected from the group consisting of tetramethylammonium, tetraethylammonium, tetra(hydroxymethyl)ammonium, and tetra(hydroxyethyl)ammonium.

4. A process as in claim 1, wherein the silicate is present in an amount of from 2 to 10% by weight based on the total weight of the plate cleaner.

5. A process as in claim 1, wherein the surface active agent is a cationic surface active agent selected from the group consisting of a trimethyl type, a benzyl type, an amine salt type, an imidazoline type, and an amide type.

6. A process as in claim 1, wherein the surface active agent is an amphoteric surface active agent selected from the group consisting of an alkylbetaine type and an alkylimidazoline type.

7. A process as in claim 1, wherein the surface active agent is present in an amount of from 0.05 to 5% by weight based on the total weight of the plate cleaner.

8. A process as in claim 1, wherein the aqueous solution further contains a nonionic surface active agent in an amount of from 0.05 to 20% by weight based on the total weight of the plate cleaner.

9. A process as in claim 8, wherein the nonionic surface active agent is a polyoxyethylene alkyl ether, a polyoxyethylene alkylphenyl ether, a sorbitan fatty acid ester, a polyoxyethylene sorbitan fatty acid ester, a polyoxyethylene sorbitol fatty acid ester, a polyoxyethylene alkylamine, a polyoxyethylene fatty acid ester, a glycerin fatty acid ester or an oxyethyleneoxypropylene block copolymer.

10. A process as in claim 8, wherein the nonionic surface active agent has an HLB value of from 8 to 20.

11. A process as in claim 8, wherein the nonionic surface active agent is present in an amount of from 0.1 to 10% by weight based on the total weight of the plate cleaner.

12. A process as in claim 1, wherein the aqueous solution further contains an organic solvent in an amount of from 0.1 to 5% by weight based on the total weight of the plate cleaner.

13. A process as in claim 12, wherein the organic solvent has a boiling point of from about 130° C. to about 300° C.

14. A process as in claim 12, wherein the organic solvent has water solubility of 10% by weight or less at 20° C.

15. A process as in claim the 12, wherein the organic solvent is ethylene glycol dibutyl ether, ethylene glycol benzyl ether, ethylene glycol phenyl ether, methylphenylcarbitol, n-amyl alcohol, methylamyl alcohol, benzyl alcohol, methylcyclohexanone, cyclohexanol, cyclohexanone, or butyl ethyl ketone.

16. A process as in claim 12, wherein the organic solvent is present in an amount of from 0.3 to 3% by weight based on the total weight of the plate cleaner.

* * * * *